US005273286A

United States Patent [19]

Sun

[11] Patent Number: 5,273,286

[45] Date of Patent: Dec. 28, 1993

[54] MULTIPLE CONCENTRIC SECTION GOLF BALL

[76] Inventor: Donald J. C. Sun, 4251 Ocean Valley La., San Diego, Calif. 92130

[21] Appl. No.: 972,523

[22] Filed: Nov. 6, 1992

[51] Int. Cl.[5] ..... A63B 37/06

[52] U.S. Cl. ..... 273/228; 273/225

[58] Field of Search ..... 273/228, 229, 220, 230, 273/62, 225, 219

[56] References Cited

U.S. PATENT DOCUMENTS

| | | | |
|---|---|---|---|
| 739,753 | 9/1903 | Kempshall | 273/228 |
| 878,070 | 2/1908 | Kingzett | 273/228 |
| 1,339,992 | 5/1920 | Wais | 273/228 X |
| 2,181,350 | 11/1939 | Smith | 273/228 |
| 4,625,964 | 12/1986 | Yamada | 273/220 X |
| 5,184,828 | 2/1993 | Kim et al. | 273/228 |

*Primary Examiner*—George J. Marlo

*Attorney, Agent, or Firm*—William W. Haefliger

[57] ABSTRACT

A multi-section golf ball comprising first, second, third, and fourth ball sections each having a spherical outer surface, and all sections having a common center; the first section being an inner core closest to the center and consisting of substantially incompressible material; the second section being an intermediate core in the form of a shell surrounding the inner core, the second section consisting essentially of carbonaceous material; the third section being an outer core in the form of a shell surrounding the intermediate core, the third section consisting essentially of an elastomer; the fourth section being a cover in the form of a shell surrounding the outer core; whereby the radius of gyration and spin rate of the golf ball can be controlled by selection of the weight, density, and size of each of the first, second and third sections.

10 Claims, 1 Drawing Sheet

MULTIPLE CONCENTRIC SECTION GOLF BALL

BACKGROUND OF THE INVENTION

This invention relates generally to the construction of golf balls, and more particularly to a ball construction characterized by multiple concentric sections, including an innermost section consisting of essentially non-compressible material allowing variations in the radial dimensions and densities of outer sections to permit control variations in spin rate of the ball.

Historically, golf balls have been produced utilizing a one-piece or unitary construction, a two-piece construction, which incorporates a solid core, and a separate cover, or three-piece construction, which is comprised of a solid or liquid-filled center, which is covered with rubber thread windings or a solid rubber shell, and finally, a cover material. The one-piece, two-piece and three-piece ball constructions have different radii of gyration, and hence different spin rates when struck by a golf club. The closer the radius of gyration is to the center of the ball, the greater the spin rate of the ball. Hence, three-piece golf balls, with a heavy solid or liquid-filled center, and the very light density created by the air spaces between the rubber thread windings, spin considerably more than solid or two-piece construction balls.

It has long been desired to be able to adjust the spin rate of the golf ball. This feature would allow the designer to design the ball for the greatest distance or for the greatest "bite" on the green, while not requiring a change in the cover material of the ball. With existing construction materials, the designer has had very little freedom to substantially change the spin rate of the ball, and the small changes, which could be made, required that substantial and often detrimental material changes be incorporated. As an example, it is known that softer cover materials will produce more spin, but only at the expense of the initial velocity of the ball.

Even the latest solid construction three-piece balls, with a solid rubber center, a solid rubber shell of a different density around the center, and finally a cover of a third density, do not allow for substantial adjustment of the spin rate of the ball, due to the fact that the polybutadiene rubber, which is used for the construction of the center and rubber shell, has a density of about 1.1 with no filler, and performance diminishes substantially if filler is added to the compound. Further, the ball performs best when the rubber material with no filler is closest to the cover of the ball. This means that, while the spin rate can be somewhat controlled, there is not a great deal of flexibility afforded the designer.

SUMMARY OF THE INVENTION

It is a major object of the invention to provide a multiple section golf ball allowing for selective adjustment in the spin rate of the ball, depending upon the densities and sizes of the sections. The invention allows a player to select a ball for play based upon a desired spin rate, i.e., higher or lower, whereby, for example, a higher spin rate ball may be used in playing where the golf course is characterized by relatively shorter tee-to-green instances, the higher spin rate ball then tending to stop, i.e., not roll excessively when landing on the green; and conversely for a golf course characterized by relatively higher tee-to-green distances, a ball of lesser spin rate may be selected, since more non-spin energy is then transmitted to the ball for greater air travel.

Basically, the multi-section golf ball of the invention comprises, in combination:

a) first, second, third, and fourth ball sections each having a spherical outer surface, and all sections having a common center, b) the first section being an inner core closest to the center and consisting of substantially incompressible material, c) the second section being an intermediate core in the form of a shell surrounding the inner core, the second section consisting essentially of carbonaceous material, d) the third section being an outer core in the form of a shell surrounding the intermediate core, the third section consisting essentially of an elastomer, and e) the fourth section being a cover in the form of a shell surrounding the outer core, f) whereby the radius of gyration and spin rate of the golf ball can be controlled by selection of the relative weights, densities, and sizes of the multiple sections.

As will appear, the sections may be bonded together, as during successive stages of molding, at spherical interfaces between the sections. Further, the inner core section may typically consist of metallic or non-metallic material having a density between 0.4 and 4.0 grams per cubic centimeter; the intermediate core may typically consist of carbonaceous material, such as reinforced carbon graphite, for example; the outer core section may typically consist of an elastomer, as for example polybutadiene rubber, with little or no filler (powdered silica, for example); and the fourth or outer cover section may consist of a material selected from the group consisting of:

i) an ionomer ii) urethane iii) balata.

Another object is to provide an improved golf ball having the characteristics described, wherein the ball section outer diameters fall within ranges to be described; and wherein the densities of the various sections also fall within ranges to be described.

Such densities and section outer diameters may be varied during ball construction to provide a selected characteristic spin rate for the ball, with advantages as referred to above.

These and other objects and advantages of the invention, as well as the details of an illustrative embodiment, will be more fully understood from the following specification and drawings, in which:

DRAWING DESCRIPTION

FIG. 1 is a cross section through a four-section golf ball incorporating the invention; and FIG. 2 is a block diagram indicating construction steps.

DETAILED DESCRIPTION

Figure 1:
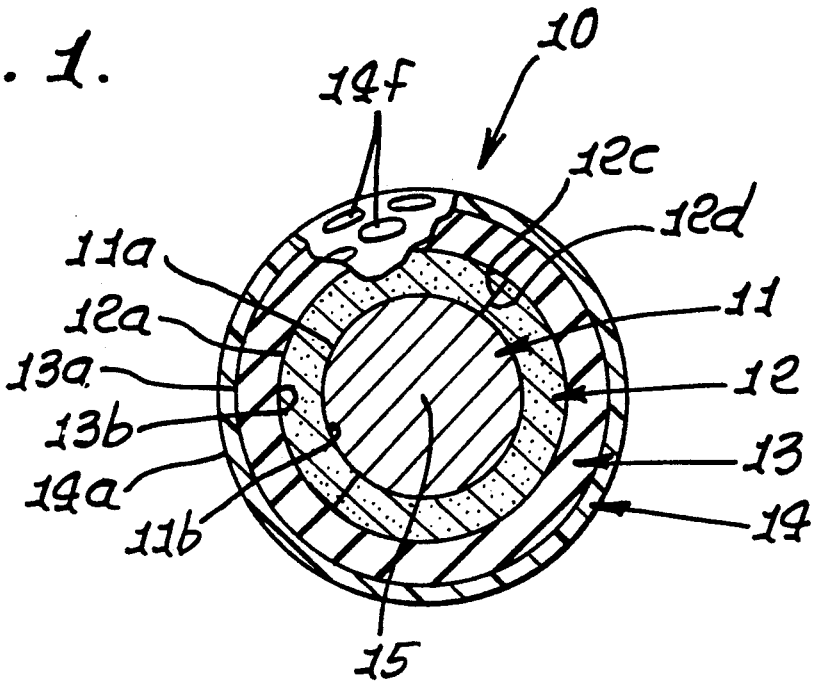

Referring first to FIG. 1, the ball 10 includes first, second, third, and fourth sections, indicated at 11, 12, 13, and 14, each section having a spherical outer surface indicated at 11*a*, 12*a*, 13*a*, and 14*a*. All such sections have a common center shown at 15, that center being the center of each spherical surface, as referred to.

The first section 11, closest to the center 15, consists of substantially incompressible material, examples being steel, zinc, water, mercury, and other solids and liquids, metallic or non-metallic. The density range of such material lies between 0.4 and 4.0 grams per cubic centimeter. If the inner core 11 is a spherical solid, the intermediate core 12 may be molded about the core 11 and bonded thereto during molding. If the core 11 is a liquid, it may be injected into the hollow formed by the core 12 and bounded by the inner surface 11*b* of the latter. Other methods of assembly can be employed.

The intermediate core 12 is in the form of a shell surrounding the inner core and having a constant radial dimension between its inner and outer surfaces. The intermediate core 12 consists essentially of carbonaceous material, one example being reinforced carbon graphite. Such graphite may have been preliminarily shaped in the form as shown and, under suitably high pressure and temperature, to provide a graphitic body, the latter then being cut in half to allow its reception of the inner core 11 therein, that inner core being a solid, in the form of a ball. The two halves of the intermediate core 12 are then bonded together as at interfaces 12*c* and 12*d*, employing a suitable adhesive. This step of forming the combined assembly 11 and 12 is indicated at 20 in FIG. 2.

Subsequently, the third section 13 is formed about the section 12 by a step indicated at 21 in FIG. 2. The third section or outer core is in the form of a shell having a constant radial dimension between its inner and outer surfaces 13*b*, 13*a*, and typically consists essentially of an elastomer. One example is polybutadiene rubber injected molded about 12 at a temperature of about 400° F., for one minute. Such molding typically bonds the interfaces between 12 and 13, i.e., at 12*a* and 13*b*.

Figure 2:
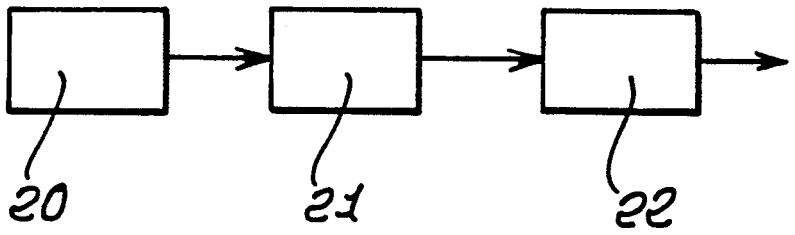

The fourth step indicated at 22 in FIG. 2 consists in forming the fourth ball section 14, being a cover for the ball in the form of a shell surrounding the outer core 13 and bonded thereto. That cover is typically surface dimpled as at 14*f* in a known manner. A typical dimpling pattern appears in U.S. Pat. No. 5,087,048, other dimple patterns being usable. The fourth section typically consists of a material selected from the group consisting of i) an ionomer
ii) urethane
iii) balata. Representative ionomers consist of blends of sodium and zinc-based ethylene, an example being the material known in the trade as SURLYN, produced by DuPont Company, or IOTEK, produced by Exxon Company. Typically, usable urethanes are thermoplastic materials within the group consisting of non-vulcanized polyester urethane elastomers, an example being ESTANE. The balata material is an elastomer, either natural or synthetic, and is known in the trade. In the case of the ionomer or urethane materials used for section 14, they may be molded over section 13 at about 400° F. for about one minute, as during injection molding, a bond being established between 13 and 14 during such molding. In the case of the use of balata, the molding step is carried out at about 200° F. for 20 minutes.

The ranges of the outer diameters of the multiple sections are as follows:

a) outer diameter of section 11 ranges between 0.25 inches and 1.125 inches;
b) outer diameter of section 12 ranges between 0.5 inches and 1.6 inches;
c) outer diameter of section 13 ranges between 1.0 inches and 1.66 inches;
d) outer diameter of section 14 is 1.68 inches.

The densities of the various sections vary as follows:

a) section 11 between 0.4 and 11.4 grams per cc;
b) section 12 between 0.2 and 4.0 grams per cc;
c) section 13 between 0.4 and 2.5 grams per cc;
d) section 14 between 0.7 and 2.5 grams per cc.

The invention allows the radius of gyration, moment of inertia and spin rate to be varied or fixed at the designer's discretion, even though the cover material density, volume or flexibility is changed.

By utilizing four striations or layers and varying the size, weight and density of each section and particularly the innermost component of the golf ball, the spin rate of the golf ball can be controlled. This allows the manufacturer to design a golf ball which is suitable for any player's needs, without necessitating a change in the cover material or rubber compound of a core. This means that the ball construction, which has the greatest initial velocity, remains essentially unchanged even though the spin rate of the ball is changed.

I claim:

1. A multi-section golf ball, comprising in combination:

a) first, second, third, and fourth ball sections each having a spherical outer surface, and all sections having a common center,
b) the first section being an inner core closest to said center and consisting of substantially incompressible material,
c) the second section being an intermediate core in the form of a shell surrounding said inner core, the second section consisting essentially of carbonaceous material,
d) the third section being an outer core in the form of a shell surrounding said intermediate core, the third section consisting essentially of an elastomer,
e) the fourth section being a cover in the form of a shell surrounding said outer core,
f) whereby the radius of gyration and spin rate of the golf ball can be controlled by selection of the weight, density, and size of each of the first, second and third sections.

2. The combination of claim 1 wherein said fourth section consists of a material selected from the group consisting of i) an ionomer
ii) urethane
iii) balata.

3. The combination of claim 1 wherein said inner core incompressible material is selected from the group consisting of metal, non-metal, liquid, and solid materials.

4. The combination of claim 1 wherein said intermediate core consists of reinforced carbon graphite.

5. The combination of claim 1 wherein said outer core consists essentially of polybutadiene rubber.

6. The combination of claim 1 wherein said inner and intermediate cores are bonded together.

7. The combination of claim 1 wherein said intermediate and outer cores are bonded together.

8. The combination of claim 1 wherein the densities of said cores are as follows:

i) inner core—between 0.4 and 11.4 grams per cc;
ii) intermediate core—between 0.2 and 4.0 grams per cc;
iii) outer core—between 0.4 and 2.5 grams per cc.

9. The combination of claim 8 wherein the density of the ball cover is between 0.7 and 2.5 grams per cc.

10. The combination of claim 1 wherein the sections have outer diameters as follows:

i) first section—between 0.25 and 1.125 inches
ii) second section between 0.5 and 1.6 inches
third section—between 1.0 and 1.66 inches
iv) forth section—1.68 inches.

* * * * *